US008142731B2

(12) United States Patent
Costiniti et al.

(10) Patent No.: US 8,142,731 B2
(45) Date of Patent: Mar. 27, 2012

(54) DEVICE FOR PROVIDING A RELATIVELY CONSTANT RATE OF DISSOLUTION OF A SOLID ARTICLE WITHIN IT

(75) Inventors: Fabio Costiniti, Mira (IT); Paul John Duffield, Hull (GB); Andrew Robert Edwards, Toronto (CA); Mark Laing, East Yorkshire (GB); Joceline Langford, Hull (GB); Kerry Anne Lawrence, North Lincolnshire (GB)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 632 days.

(21) Appl. No.: 11/916,597

(22) PCT Filed: Jun. 13, 2006

(86) PCT No.: PCT/GB2006/002151

§ 371 (c)(1),
(2), (4) Date: Dec. 5, 2007

(87) PCT Pub. No.: WO2006/134338

PCT Pub. Date: Dec. 21, 2006

(65) Prior Publication Data

US 2008/0202172 A1 Aug. 28, 2008

(30) Foreign Application Priority Data

Jun. 13, 2005 (GB) ..... 0511943.3

(51) Int. Cl.
*B01D 11/02* (2006.01)

(52) U.S. Cl. ..... 422/264; 422/263; 422/277; 68/13 A

(58) Field of Classification Search ..... None
See application file for complete search history.

(56) References Cited

U.S. PATENT DOCUMENTS

| | | | | |
|---|---|---|---|---|
| 3,633,538 | A * | 1/1972 | Hoeflin | 68/20 |
| 3,947,971 | A | 4/1976 | Bauer et al. | |
| 4,857,950 | A | 8/1989 | Takase et al. | |
| 4,893,422 | A | 1/1990 | Mahlich et al. | |
| 5,211,689 | A | 5/1993 | Kobayashi et al. | |
| 5,978,994 | A | 11/1999 | Anderson et al. | |
| 6,212,332 | B1 | 4/2001 | Sham et al. | |

(Continued)

FOREIGN PATENT DOCUMENTS

EP 0249440 A 12/1987

(Continued)

OTHER PUBLICATIONS

International Preliminary Examination Report on Patentability from PCT Application No. PCT/GB2006/002151.

(Continued)

*Primary Examiner* — Walter D Griffin
*Assistant Examiner* — Timothy Cleveland
(74) *Attorney, Agent, or Firm* — Norris McLaughlin & Marcus PA

(57) ABSTRACT

A device for providing a relatively constant rate of dissolution of a solid article (2) within it has one or more opening (22) to allow the passage of water. There is a flow pathway between said one or more openings and the solid article, which flow pathway is obturated by a water-permeable packing (26), through which water must pass, in entering or leaving the device.

10 Claims, 4 Drawing Sheets

U.S. PATENT DOCUMENTS 6,523,371 B1 2/2003 Sherratt et al.

FOREIGN PATENT DOCUMENTS

| | | | |
|---|---|---|---|
| EP | 0290332 | A | 11/1988 |
| EP | 0749720 | A | 12/1996 |
| EP | 0328863 | A | 8/1999 |
| GB | 2406340 | A | 3/2005 |
| JP | 63222796 | A | 9/1988 |
| JP | 2003024688 | A | 1/2003 |
| WO | 97/01625 | A | 1/1997 |
| WO | 99/41442 | A | 8/1999 |
| WO | 2005/012473 | A | 2/2005 |

OTHER PUBLICATIONS

English Language Equivalent Abstract of EP0290332.
English Language Equivalent of JP2003024688.

* cited by examiner

Top profile

Side Profile 2
4
6
8
Sponge 26
20
28
22
Mesh to allow water flow
14
10
27
24
16
18
30
Plastic Inner Housing
Sponge to act as spring 12
Window
Sponge Outer Casing

DEVICE FOR PROVIDING A RELATIVELY CONSTANT RATE OF DISSOLUTION OF A SOLID ARTICLE WITHIN IT

This is an application filed under 35 USC 371 of PCT/GB2006/002151.

This invention relates to a device which retains a solid article, which is allowed to dissolve in water, over an extended period.

Solid articles used in cleaning operations—for example fabric detergent tablets, dishwasher detergent tablets and water-softening tablets—are widely available and are generally designed to be consumed in a single cleaning or water-softening operation.

It would be desirable to provide multi-operation articles of this type and proposes have been made, but these have not been technically successful and/or have failed to gain commercial acceptance. In our earlier patent application, WO 2005/012473A, we describe a method of making cleaning or water-softening tablets by extruding a mixture into strands, which may be separated into tablets. It is mentioned that the resulting tablets may be consumed in one operation, or may last through several operations (e.g. washes of a ware-washing machine). Such tablets may suitably be in the form of a stick or rail in shape.

Thus, a tablet, whether in the form of a block, or a stick or rail, has already been proposed for multiple cleaning or water-softening operations. However, it is difficult to control the rate of dissolution of such a tablet. It is to be expected that a naked multi-operation tablet will have its highest rate of dissolution in the first cleaning or water-softening operation, when its surface area is largest. On subsequent cleaning or water-softening operations the rate of dissolution may be expected to drop progressively. When there are large differences in the rates of dissolution during different operations, at least some of those operations may be compromised as a result.

It is an object of the present invention to achieve a relatively constant rate of dissolution from a solid article, through multiple operations.

In accordance with the first aspect of the present invention there is provided a device for providing a relatively constant rate of dissolution into water of a solid article retained within it, wherein the device has one or more openings to allow the passage of water, and wherein there is a flow pathway between said one or more openings and the solid article, which flow pathway is obturated by a water-permeable packing.

The solid article could be a flowable particulate material but is preferably a coherent solid article, for example a gel or, most preferably, a particulate material consolidated into the form of a solid article. Most preferably it is a solid article formed by an extrusion of particulates, preferably substantially as described in WO 2005/012473A.

Preferably, the solid article is of a water-softening composition; preferably a water-softening composition substantially as described in WO 2005/012473A.

Definitions thereof given in WO 2005/012473A are incorporated in here by reference.

Most preferably the solid article is a tablet of water-softening composition. The tablet may be in the form of a stick or rail or bar, or may be in the form of a cuboid block, or may be disc-shaped or puck-shaped.

Preferably the device provides a seating for the solid article. The seating may be a recess of shape generally matching the shape of the solid article; preferably in the form of a socket into which the solid article fits. The seating may be provided in a liner or insert part separate from the body of the device or may be provided in the body itself. Preferably the solid article may be replaced in the seating once it has been consumed through use. In alternative embodiments the seating and the solid article are together introduced into the device when the previous solid article has been consumed; the previous seating, now empty, then being replaced. Such embodiments have the advantage that the solid article does not have to be handled.

Preferably the device has an external surface which means that the solid article does not rattle and bang against the inside surface of a machine in which it is used, e.g. a ware-washing machine. Preferably the external surface of the device is of elastomeric material or, if not an elastomeric material, of a thermoplastics material which has a degree of flexibility or "give". The external surface may be of elastomeric or plastics foam or sponge material, especially an injection moulded polyurethane foam. A preferred foam or sponge for this purpose has the property that a vertical load of 1.5 Kg will compress a 70 mm diameter sphere of the material by 10-30 mm.

Preferably there is a plurality of said openings. In one embodiment these may be provided in a face of the device, in "pepper pot" manner. In another embodiment they are provided in a mesh.

Preferably said one or more openings are provided in an end region of the device, opposite to an end face of the solid article inside the device, with said water-permeable packing located between said end face of the solid article and said one or more openings. Preferably an array of openings, for example a grid or mesh, is provided whose span substantially matches the adjacent end face.

Preferably the water-permeable packing is a compressible material, which is held in compression in use. In use the packaging is preferably compressed to not more than one-half of its at rest height; preferably to not more than one-third. The packing may be compressed when the device is assembled, whether during manufacture or during assembly by the user.

Preferably in use the packing is compressed from a rest height of 30-50 mm, to an initial working height of 5-15 mm.

In one, preferred, embodiment water can only reach the solid article by passing through said water-permeable packing.

The water-permeable packing may be a fabric or, preferably, a sponge. The sponge may be comprised of a foam of open-cell material, but most preferably it is comprised of reticulated foam, as this appears to give better results than an open-cell foam.

Preferably the other end face of the solid article opposite to said water-permeable packing, rests against a resilient means which urges the solid article against the aforementioned packing. The resilient means may for example be a spring disc or a second packing. Thus, the solid article is preferably retained between the resilient means and the first-mentioned packing, respectively engaging opposite ends of the solid article. Preferably the resilient means is also a water-permeable packing. It may be of identical material to that of the first-mentioned water-permeable packing.

A device having a compressed water-permeable packing appears to offer excellently consistent rates of dissolution. Without being bound by any theory, we surmise that as the tablet reduces in size as a consequence of its dissolution, the packing expands and offers easier passage of water. This tends to promote dissolution whilst the reduction of the tablet has the opposite effect.

Preferably the device has a casing with a main cavity, containing the solid article. When the solid article is in the form of a stick or rail, the device is preferably of generally elongate form, preferably somewhat flattened.

The device may have a displaceable or removable lid. Preferably the lid is hinged to the body of the device, in a flip-top arrangement. Preferably the lid has said one or more openings. The first-mentioned water-permeable packing may be retained within the lid, and undergo compression when the lid is closed. Preferably the closure of the lid is by means of a resiliently displaceable catch. When a second water-permeable packing is provided it is preferred that this too undergoes compression when the first-mentioned water-permeable packing undergoes compression; the tablet thus being held between the two packings under a compression force.

Preferably the device has an opening or window, through which the solid article may be viewed. The user can thereby see when the solid article needs replacing—simply, it can no longer be seen through the opening or window.

Preferably the device may be used for at least three cleaning or water-softening operations, more preferably at least four operations and most preferably for at least five operations, before the solid article is exhausted. The rate of release is relatively constant between one operation and the next. We can measure the rate of dissolution by weighing the solid article between operations. Rate of dissolution is "relatively constant" within the meaning of this specification if in any three consecutive cleaning or water-softening operations one measures the amount of the solid article which has dissolved, in a normal ware-washing machine cycle at 40° C., and averages the three values to give the mean amount dissolved, and the amount dissolved in each individual operation is within 20% of the mean amount; most preferably within 10%, which we regard as "highly constant".

Preferably the solid article weighs at least 40 g, more preferably at least 60 g. Preferably it weighs up to 180 g, more preferably up to 150 g, most preferably up to 100 g.

Preferably the amount of the solid article which dissolves in one operation is at least 8 g, more preferably at least 10 g, most preferably at least 14 g. Most preferably the amount of the solid article which dissolves in one operation is up to 30 g, more preferably up to 20 g, most preferably up to 16 g.

In accordance with the second aspect of the present invention there is provided a method of delivering an agent, in particular a water-softening agent, into an aqueous environment, wherein the method uses a device of the present invention as defined above, during a plurality of cycles of operation without replacement of the solid article.

Preferably, once the solid article has been exhausted, a new solid article is introduced into the device.

In accordance with a third aspect of the present invention there is provided a method of softening water in a ware-washing machine, the method comprising providing a single device of the first aspect, without replacement of the solid article, during a plurality of cycles of operation.

The invention will now be further described, by way of example, with reference to the accompanying drawings in which.

Figures 1, 2, 3, 4:
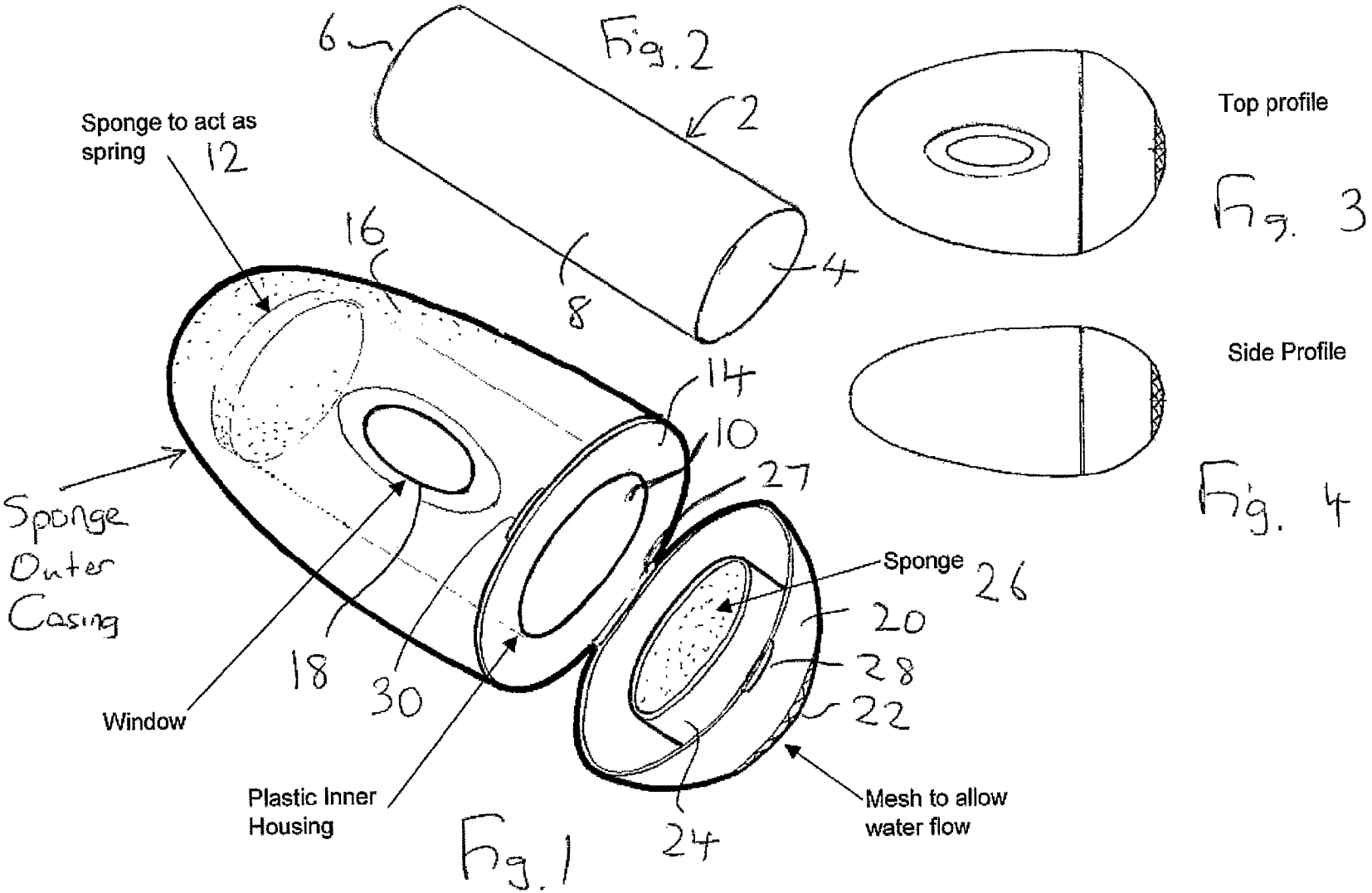
FIG. 1 is a perspective view of the first embodiment of device in accordance with the invention, with its lid open.
FIG. 2 is a tablet of solid water-softening composition to be located in the device of FIG. 1.
FIG. 3 is a plan view of the device of FIG. 1, with the lid closed.
FIG. 4 is a side elevation of the device of FIG. 1, with the lid closed.

The device of FIG. 1 is designed to retain the bar-shaped tablet of FIG. 2, and control its rate of dissolution/release, in operation in a ware washing machine.

The tablet is an extruded bar 2 which is oval in cross-section. It has oval end-faces 4, 6, and an elliptically cylindrical wall 8 therebetween. It weighs 75 g. It is a consolidation up of initially particulate water-softening agents.

The device has a cavity 10, in the form of a blind bore. The cavity is of shape and size to admit the bar 2 with a slight clearance therebetween. At the base of the cavity is an elliptical sponge 12. At the other end of the cavity, adjacent to the opening into the cavity, is an outward flange 14, co-moulded with the cavity 10. This co-moulding is removable from the device. The co-moulding fits inside an outer casing 16 of firm sponge material. A viewing window 18 is left, within the outer casing 16. The cavity is formed of a transparent or translucent material. Accordingly the user can look through the window 18 to see whether the water-softening bar has been exhausted.

A lid 20 is co-moulded with the flange 14. The lid is generally dome-shaped, and at the top of its dome there is provided a plastics mesh 22, through which water can flow, in use. The span of the plastic mesh, by which we mean its area and size, substantially matches the end face 4 of the water-softening bar. On the underside of the lid 20 there is moulded an elliptically cylindrical wall 24 within which a sponge 26 of reticulated PU foam of grade 70 pores per inch (ppi) is secured. The lid has a hinge 27 by means of which it is connected to the flange 14. The lid is formed, on its side opposite to the hinge 27, with a first catch part 28 which can provide a snap-fit with a second catch part 30, on the flange 14.

The device is of generally elongate form, somewhat flattened in one direction (see FIG. 4 compared with FIG. 3), but substantially elliptical in any given cross-section perpendicular to the axis of the bar.

To use the device, the water-softening bar 2 is located within the cavity 10, and the lid 20 is snapped shut. When this happens the sponge 26 presses against the end face of the bar. The bar is urged against the opposite sponge 12, and so is held between the sponges, both highly compressed, to a height of about one-quarter of their at-rest heights and thus together exerting a compressive force on the bar. The bar can be seen through the window 18.

The device is placed within a ware-washing machine. Water can only reach the water-softening bar via the mesh 22 and through the water-permeable sponge 26, and water charged with dissolved water-softening composition can only leave the device by the same route. This provides effective control of the rate of dissolution of water-softening composition.

The device is intended to be used for 4-7 operations of the ware-washing machine, after which time the water-softening bar is exhausted and has disappeared. Its absence is apparent when looking through the window 18. The user may open the lid and insert a new water-softening bar, close the lid again, and use the re-charged device.

Experimental work using the device of FIGS. 1 to 4 will now be described.

For comparison purposes the device was tested against some modified devices of this type. The variants tested were:

a. reticulated PU foam sponge 26, 90 ppi; mesh 22 (as described above).

b. reticulated PU foam sponge 26, 90 ppi; "pepper-pot" holes, of area 25 $mm^2$ in total, covering the same span as the mesh.

c. open cell PU foam 26, 40-70 ppi; mesh 22.

d. open cell PU foam 26, 40-70 ppi; "pepper-pot" holes, of area 25 $mm^2$ in total, covering the same span as the mesh.

Figure 5:
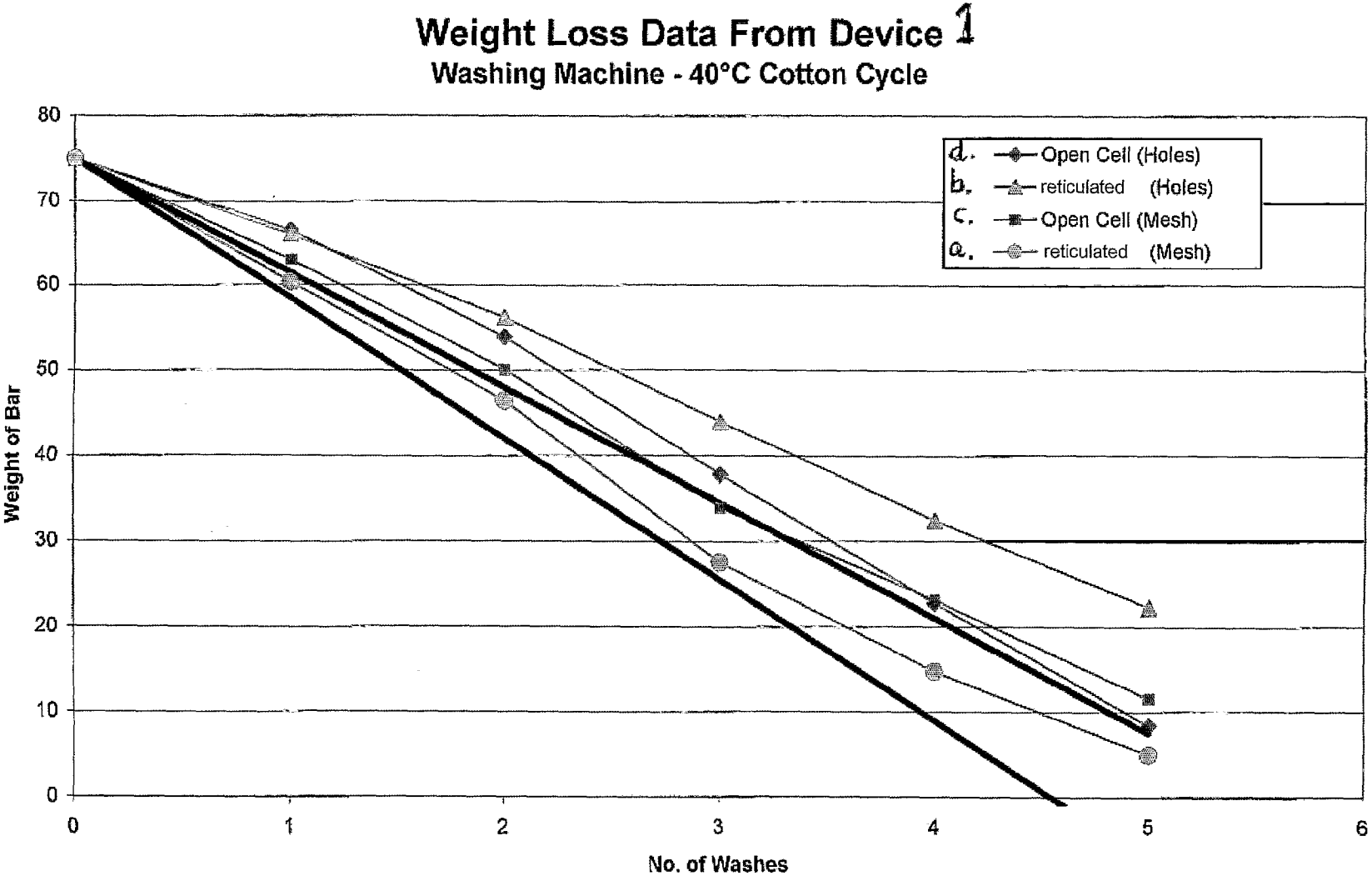
FIG. 5 is a graph displaying results from testing the first embodiment.

The work employed a standard domestic washing machine operated at the regular 40° C. cycle, containing clothes and with 75 g of proprietary biological washing detergent present. The thick straight lines on FIG. 5 represent theoretical dissolution at an even, notional, rates of 16.5 g and 13.5 g (±10% of the idealised target of 15 g per wash). An optimal tablet would produce a line of the graph falling between those lines.

It will be seen that the device gave remarkably even release of the water-softening composition, over several washes. It was evident that the device was providing effective control of rate of dissolution. With the type of water-softening bar tested, if it is put naked into the fabric washing machine it dissolves completely in one operation. Even with a device which reduces the rate of dissolution, it is to be expected that the rate of dissolution will initially be higher, and then reduce as the bar reduces in size and, therefore, provides a smaller surface area. There is no indication whatsoever that this happens with the device of the first embodiment.

Figure 6:
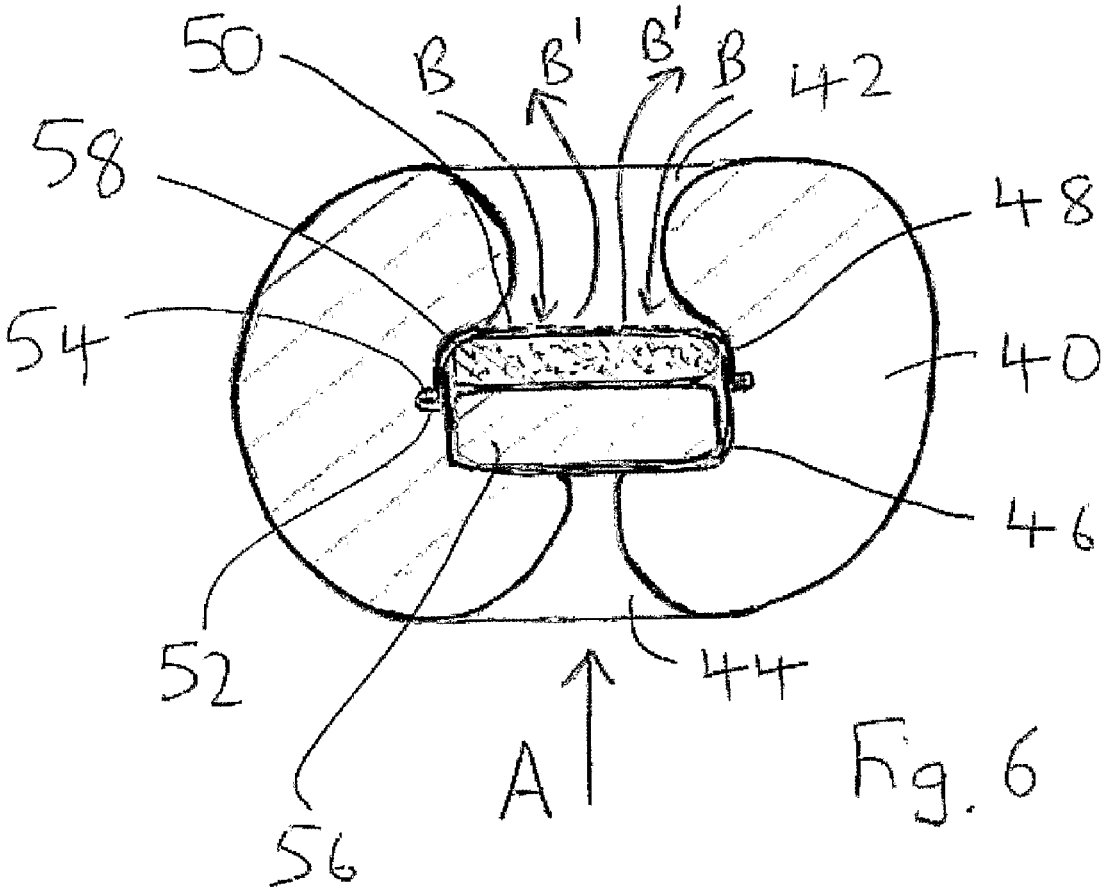
FIG. 6 is a cross-sectional view of a second embodiment of a device in accordance with the invention.

The device of FIG. 6 is not elongate like the device of FIGS. 1-4. It is generally ball-shaped. To be more accurate its shape resembles that of a Bramley apple. It has a sponge body 40 extending around it, the sponge body having upper and lower openings 42 and 44 formed in it. In the middle or core of the body there is provided a cylindrical water-softening cell having an upwardly open base part 46 and, extending over it, a downwardly facing lid part 48. The lid part 48 has an upper surface with perforations 50. In other regions the lid part 48 and the base part 46 are not perforated. The sponge body 40 is wrapped around the water-softening cell, so as to engage the base part, and to engage, albeit to a lesser extent, the lid part 48. At its "core" the sponge of the body 40 is formed with a circular groove 52. The distal edge of the lid part 48 is formed with an outward flange 54 which is located within the groove 52. Thus, the water-softening cell is located firmly in place within the sponge body, in use, being engaged on its top and bottom surfaces, and by the engagement of the flange 54 within the groove 52. However, the sponge body 40 is relatively flexible and can be manipulated to remove the water-softening cell. To do this the upper region of the sponge body 40 is splayed (i.e. the opening 42 is widened) with the fingers, while the water-softening cell may be urged upwards by pushing a finger or pen into the opening 44, in the direction shown by the arrow A.

Within the water-softening cell there is provided, at the base of the base part 46, a puck- or disc-shaped water-softening tablet 56; and, above the tablet, a correspondingly-shaped water-permeable sponge 58 of reticulated PU foam, 90 ppi. When the lid part is engaged on the base part and the water-softening cell set in place within the body 40, the lid part is pushed down onto the base part and the sponge 58 is thereby highly compressed. Again, the only way that water can reach the tablet 56, or leave it carrying dissolved water-softening agents, is through the sponge (as shown schematically by the arrows B, B').

The device of FIG. 6 was tested in identical manner to that described for the device of FIGS. 1-4. The device was in one form, as described above, without variations in terms of the water-permeable sponge, or the openings.

Figure 7:
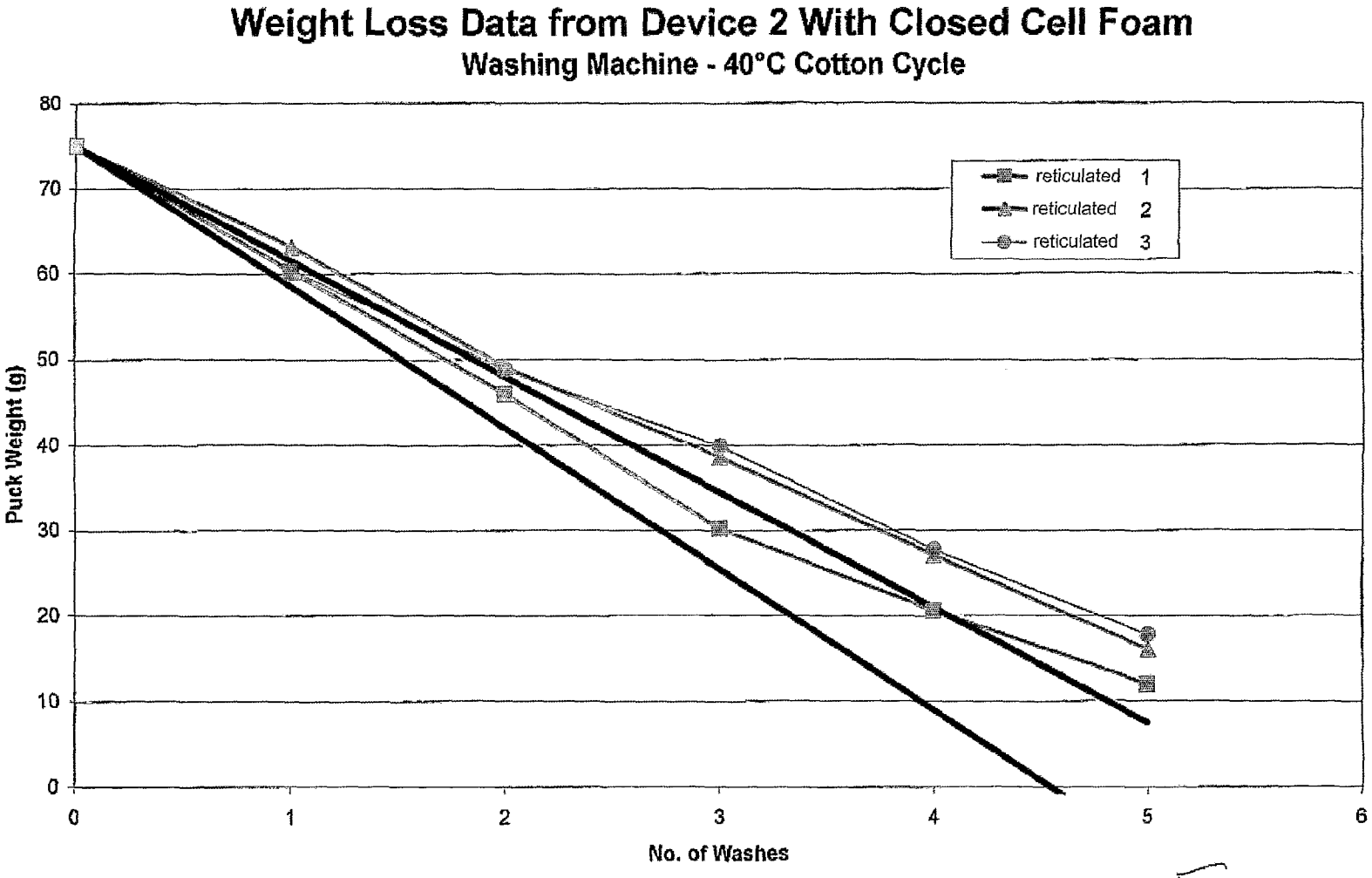
FIG. 7 is a graph displaying results from testing the second embodiment.

The results of three replicates are shown in FIG. 7. For guidance purposes the strong lines are drawn on to represent notional release rates of 13.5 g per wash, and 16.5 g per wash.

The results of the three replicates are very consistent. They show that the device of FIG. 6 gives very steady release of water-softening composition, close to the ideal.

The steady dissolution is believed to be because the tablet reduces in size, reducing dissolution, but as it does so the sponge expands, improving water ingress/egress. These two effects work in opposite directions and to some degree are believed to compensate for each other.

The invention claimed is:

1. A device for providing a relatively constant rate of dissolution into water of a solid tablet retained within it, wherein the device comprises one or more openings provided in an end region of the device to allow the passage of water, and wherein there is a flow pathway between said one or more openings and the solid tablet, which flow pathway is obturated by a water-permeable packing located between an end face of the solid tablet and said one or more openings, wherein the solid tablet is urged against the water-permeable packing such that water may reach the solid tablet only by passing through the water-permeable packing and the water-permeable packing is held under compression by the solid tablet in the device.

2. A device as claimed in claim 1 wherein the solid article is a coherent solid tablet formed from particulate material.

3. A device as claimed in claim 1 wherein the solid tablet is of a water-softening composition.

4. A device as claimed in claim 1 wherein the solid tablet weighs from 40 to 120 g.

5. A device as claimed in claim 1 wherein the device has an elastomeric or plastics external surface.

6. A device as claimed in claim 1 wherein the water-permeable packing is of closed-cell foam.

7. A device as claimed in claim 1 wherein the solid article once consumed is replaceable within the device.

8. A device as claimed in claim 1 wherein, in use, water can only reach the solid tablet by passing through the water-permeable packing.

9. A device as claimed in claim 1 wherein the device has an opening or window through which the solid tablet can be viewed.

10. A method of delivering an active agent into an aqueous environment, wherein the method comprises the step of supplying the device according to claim 1, during a plurality of cycles of operation without replacement of the solid article.

* * * * *